US008920708B2

(12) United States Patent
Serizawa et al.

(10) Patent No.: US 8,920,708 B2
(45) Date of Patent: Dec. 30, 2014

(54) COOLING DEVICE OF HOT-ROLLED STEEL STRIP

(75) Inventors: Yoshihiro Serizawa, Tokyo (JP); Yasuhiro Nishiyama, Tokyo (JP); Shigeru Ogawa, Tokyo (JP); Shinji Ida, Tokyo (JP); Hitoshi Nikaidoh, Tokyo (JP); Isao Yoshii, Tokyo (JP); Noriyuki Hishinuma, Tokyo (JP); Tetsuo Kishimoto, Tokyo (JP); Nobuhiro Takagi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 199 days.

(21) Appl. No.: 13/584,973

(22) Filed: Aug. 14, 2012

(65) Prior Publication Data

US 2012/0306130 A1 Dec. 6, 2012

Related U.S. Application Data

(62) Division of application No. 13/319,600, filed as application No. PCT/JP2010/003238 on May 13, 2010, now Pat. No. 8,414,716.

(30) Foreign Application Priority Data

May 13, 2009 (JP) ..... P2009-116547

(51) Int. Cl.
*C21D 1/667* (2006.01)
*C21D 6/00* (2006.01)
*B21B 45/02* (2006.01)

(52) U.S. Cl.
CPC ..... *B21B 45/0218* (2013.01)
USPC ..... 266/114; 148/661

(58) Field of Classification Search
USPC ..... 266/114, 115
See application file for complete search history.

(56) References Cited

U.S. PATENT DOCUMENTS

| | | | | |
|---|---|---|---|---|
| 4,371,149 | A * | 2/1983 | Takeuchi et al. | 266/90 |
| 2006/0113013 | A1 | 6/2006 | Fujibayashi et al. | |
| 2009/0108508 | A1 | 4/2009 | Ueoka et al. | |

FOREIGN PATENT DOCUMENTS

| | | | |
|---|---|---|---|
| DE | 2 161 022 | A1 | 6/1973 |
| EP | 1 935 521 | A1 | 6/2008 |
| JP | 2001-164323 | A | 6/2001 |

(Continued)

OTHER PUBLICATIONS

Extended European Search Report dated May 3, 2012 issued in corresponding European patent application No. 10774726.3.

(Continued)

*Primary Examiner* — Deborah Yee
(74) *Attorney, Agent, or Firm* — Birch, Stewart, Kolasch & Birch, LLP

(57) ABSTRACT

The present invention provides a method of cooling a hot-rolled steel strip which has passed through a finishing rolling, including: cooling the hot-rolled steel strip from a first temperature of not lower than 600° C. and not higher than 650° C. to a second temperature of not higher than 450° C. with cooling water having the water amount density of not lower than 4 $m^3/m^2/min$ and not higher than 10 $m^3/m^2/min$, wherein with respect to the area of the target surface, the area of a portion where a plurality of spray jets of the cooling water directly strikes on the target surface is at least 80%.

9 Claims, 7 Drawing Sheets

(56) References Cited

FOREIGN PATENT DOCUMENTS

| | | | |
|---|---|---|---|
| JP | 2006-35311 | A | 2/2006 |
| JP | 2008-110353 | A | 5/2008 |
| JP | 2009-52065 | A | 3/2009 |
| KR | 10-2008-0047483 | A | 5/2008 |

OTHER PUBLICATIONS

International Search Search Report, corresponding to PCT/JP2010/003238, dated Aug. 17, 2010.

Korean Notice of Preliminary Rejection, dated Mar. 20, 2012, for Korean Application No. 10-2011-7027185, including English translation.

* cited by examiner

COOLING DEVICE OF HOT-ROLLED STEEL STRIP

This application is a Divisional of U.S. patent application Ser. No. 13/319,600, filed Nov. 9, 2011, now U.S. Pat. No. 8,414,716 which is the U.S. National Phase of PCT/JP2010/003238, filed May 13, 2010. Priority is claimed thereto under 35 USC 120. This application also claims priority under 35 USC 119(a) to Japanese Patent Application No. 2009-116547, filed in the Japan on May 13, 2009, the contents of which are incorporated herein by reference.

TECHNICAL FIELD

The present invention relates to a cooling method and a cooling device for cooling a hot-rolled steel strip while feeding the same which has passed through a finishing rolling for a hot-rolling process.

BACKGROUND ART

A hot-rolled steel strip which has passed through a finishing rolling for a hot-rolling process (hereinafter, referred to as "steel strip") is transported from a finishing rolling mill to a coiler by using a run-out table. The steel strip under the transportation is cooled to a predetermined temperature by means of cooling devices which are provided above and under the run-out table, and then, is coiled by the coiler. Since the cooling manner of the steel strip after passing through the finishing rolling has a significant influence on the mechanical property of the steel strip, it is important to uniformly cool the steel strip to a predetermined temperature.

Usually, the cooling of the steel strip after passing through the finishing rolling is carried out by using, for example, water (hereinafter, referred to as "cooling water") as a cooling medium. In this case where the steel strip is cooled with the cooling water, a cooling state of the steel strip changes depending on the temperature of the steel strip. For example, in a general laminar cooling process, as illustrated in FIG. 9, (1) when the surface temperature T of the steel strip is not lower than approximately 600° C., the steel strip is cooled in a film boiling state A, (2) when the surface temperature T of the steel strip is not higher than approximately 350° C., the steel strip is cooled in a nucleate boiling state B, and (3) when the surface temperature T of the steel strip is in the temperature range between the film boiling state A and the nucleate boiling state B, the steel strip is cooled in a transition boiling state C. Here, the "surface temperature" means the temperature of a steel strip surface being cooled with the cooling water.

In the film boiling state A, when the cooling water is ejected onto the steel strip, the cooling water immediately vaporizes on the surface of the steel strip, whereby a vapor film covers the surface of the steel strip. When the steel strip is cooled in the film boiling state A, since this vapor film cools the steel strip, a cooling performance is low but the coefficient of heat transfer h is substantially constant, as illustrated in FIG. 9. Therefore, as illustrated in FIG. 10, the heat flux (heat flow rate) Q decreases as the surface temperature T of the steel strip decreases. Generally, in a case where the inside temperature of the steel strip is high, the surface temperature is also high due to the heat conduction from the inside of the steel strip. Accordingly, in the film boiling state A, a portion of the steel strip where the surface temperature is high rapidly cools down, and a portion of the steel strip where the surface temperature is low slowly cools down. As a result, even if the inside temperature or the surface temperature of the steel strip is locally varied, the temperature deviation in the steel strip decreases as the cooling proceeds.

In the nucleate boiling state B, when the cooling water is ejected onto the steel strip, the cooling water comes into direct contact with the surface of the steel strip without generating the above-described vapor film. Therefore, the coefficient of heat transfer h of the steel strip cooled in the nucleate boiling state B is higher than the coefficient of heat transfer h of the steel strip cooled in the film boiling state A, as illustrated in FIG. 9. In addition, as illustrated in FIG. 10, the heat flux Q decreases as the surface temperature of the steel strip decreases. Accordingly, in the nucleate boiling state B, the temperature deviation in the steel strip decreases as the cooling proceeds, as in the film boiling state A. Meanwhile, the heat flux Q ($W/m^2$) can be calculated by using the following Formula (1), where the h ($W/(m^2 \cdot K)$) is the coefficient of heat transfer, the T (K) is the surface temperature of the steel strip, and the W (K) is the temperature of the cooling water ejected onto the steel strip.

$$Q = h \times (T - W) \qquad \text{Formula (1)}$$

However, in the transition boiling state C in which a film boiling state portion and a nucleate boiling state portion are generated, a portion cooled through the vapor film and a portion brought into direct contact with the cooling water coexists. In this transition boiling state C, the coefficient of heat transfer h and the heat flux Q increase as the surface temperature of the steel strip decreases. This is because the contact area between the cooling water and the steel strip increases as the surface temperature of the steel strip decreases.

Accordingly, a portion where the surface temperature T of the steel strip is high, that is, a portion where the inside temperature is high slowly cools down, while a portion where the surface temperature T of the steel strip is low rapidly cools down. As a result, if a local temperature variation occurs in the steel strip, this temperature variation significantly increases. That is, during the cooling of the steel strip in the transition boiling state C, the temperature deviation in the steel strip increases as the cooling proceeds, thus, it is impossible to achieve the uniform cooling of the steel strip.

Patent Document 1 discloses a method including a step that stops cooling before reaching a transition boiling start temperature, and a step that subsequently cools the steel strip with cooling water in the water amount density (amount of water per unit area and unit time supplied on the steel strip) by which the cooling water becomes the nucleate boiling state. In this cooling method, based on the fact that the transition boiling start temperature and the nucleate boiling start temperature shift to the higher temperature side as the water amount density of the cooling water ejected onto the steel strip increases, after cooling the steel strip in the film boiling state, the steel strip is subsequently cooled in the nucleate boiling state by increasing the water amount density of the cooling water.

RELATED ART DOCUMENT

Patent Document

[Patent Document 1] Japanese Unexamined Patent Application, First Publication No. 2008-110353

DISCLOSURE OF THE INVENTION

Problems to be Solved by the Invention

However, in the method disclosed in Patent Document 1, the cooling water having the water amount density of not higher than 3 $m^3/m^2/min$ is linearly (in a rod-like manner) ejected onto the steel strip. The inventors carried out studies and then found out that, when the method as disclosed in Patent Document 1 is employed, it is impossible to avoid the steel strip from being cooled in the transition boiling state, and thus, the temperature deviation increases as the cooling proceeds.

As described above, the temperature deviation in the steel strip decreases when the steel strip is cooled in the film boiling state and the nucleate boiling state. Accordingly, if the steel strip is cooled only in the film boiling state and the nucleate boiling state so as to avoid the transition boiling state, it is supposed that the temperature deviation in the steel strip after the nucleate boiling state cooling is smaller than the temperature deviation in the steel strip after the film boiling state cooling.

However, according to Table 1 and Table 2 of Patent Document 1, the temperature deviation in the steel strip at the exit side of a second run-out table (nucleate boiling state) is larger than the temperature deviation in the steel strip at the exit side of a first run-out table (film boiling state). This is the evidence that, in the cooling method disclosed in Patent Document 1, the temperature deviation in the steel strip increases due to the cooling of the steel strip in the transition boiling state. Accordingly, by the technique in Patent Document 1, it is impossible to achieve the uniform cooling of the steel strip.

The present invention is made in view of the above problems, and an object of the present invention is to achieve a uniform cooling of a hot-rolled steel strip, in a hot-rolled steel strip cooling process performed after passing through a finishing rolling for a hot-rolling process.

Means for Solving the Problems

The present invention employs the following methods or configurations to solve the above problems.

(1) A first aspect of the present invention is a method of cooling a hot-rolled steel strip which has passed through a finishing rolling. In this method, a target surface of the hot-rolled steel strip is cooled from a first temperature of not lower than 600° C. and not higher than 650° C. to a second temperature of not higher than 450° C., with cooling water having the water amount density of not lower than 4 $m^3/m^2/min$ and not higher than 10 $m^3/m^2/min$. With respect to the area of the target surface, the area of a portion where a plurality of spray jets of the cooling water directly strike on the target surface is at least 80%.

(2) In the method of cooling the hot-rolled steel strip according to (1), the cooling water may be ejected such that the cooling water strikes on the target surface with the velocity of not lower than 20 msec.

(3) In the method of cooling the hot-rolled steel strip according to (1) or (2), the cooling water may be ejected such that the cooling water strikes on the target surface with the pressure of not lower than 2 kPa.

(4) In the method of cooling the hot-rolled steel strip according to (1) or (2), the cooling water may be ejected in a substantially conical shape, and the impact angle of the cooling water to the target surface may be not smaller than 75 degrees and not larger than 90 degrees when viewed from the steel strip rolling direction.

(5) In the method of cooling the hot-rolled steel strip according to (1) or (2), the cooling water which flows on an upper surface of the hot-rolled steel strip may be blocked at the upstream side from a position where a supply of the cooling water starts, and the cooling water which flows on the upper surface of the hot-rolled steel strip may be blocked at the downstream side from a position where the supply of the cooling water finishes.

(6) In the method of cooling the hot-rolled steel strip according to (1) or (2), an upper surface and a lower surface of the hot-rolled steel strip may be cooled, while controlling a cooling performance for the upper surface of the hot-rolled steel strip to be not less than 0.8 times and not more than 1.2 times of a cooling performance for the lower surface of the hot-rolled steel strip.

(7) In the method of cooling the hot-rolled steel strip according to (1) or (2), only an upper surface of the hot-rolled steel strip may be cooled.

(8) A second aspect of the present invention is a cooling device that cools a hot-rolled steel strip which has passed through a finishing rolling. The cooling device includes a rapid cooling device that cools a target surface of the hot-rolled steel strip from a first temperature of not lower than 600° C. and not higher than 650° C. to a second temperature of not higher than 450° C., with cooling water having the water amount density of not lower than 4 $m^3/m^2/min$ and not higher than 10 $m^3/m^2/min$. With respect to the area of the target surface, the area of a portion where a plurality of spray jets of the cooling water directly strike on the target surface is at least 80%.

(9) In the cooling device that cools the hot-rolled steel strip according to (8), the rapid cooling device may include a plurality of spray nozzles that eject the cooling water, the plurality of the spray nozzles ejecting the cooling water such that the cooling water strikes on the target surface with the velocity of not lower than 20 msec.

(10) In the cooling device that cools the hot-rolled steel strip according to (8) or (9), the rapid cooling device may include a plurality of spray nozzles that eject the cooling water, the plurality of the spray nozzles ejecting the cooling water such that the cooling water strikes on the target surface with the pressure of not lower than 2 kPa.

(11) In the cooling device that cools the hot-rolled steel strip according to (8) or (9), each of the plurality of the spray nozzles may eject the cooling water in a substantially conical shape, and the impact angle of the cooling water to the target surface is not smaller than 75 degrees and not larger than 90 degrees when viewed from the steel strip rolling direction.

(12) The cooling device that cools the hot-rolled steel strip according to (8) or (9) may further include: a first water-blocking mechanism that blocks the cooling water which flows on an upper surface of the hot-rolled steel strip at the upstream side from a position where a supply of the cooling water starts; and a second water-blocking mechanism that blocks the cooling water which flows on the upper surface of the hot-rolled steel strip at the downstream side from a position where the supply of the cooling water finishes.

(13) In the cooling device that cools the hot-rolled steel strip according to (12), the first water-blocking mechanism may include a first water-blocking nozzle that ejects blocking water to the upstream side from the target surface; and the second water-blocking mechanism may include a second water-blocking nozzle that ejects blocking water to the downstream side from the target surface.

(14) In the cooling device that cools the hot-rolled steel strip according to (13), the first water-blocking mechanism may include a first water-blocking roll provided at the downstream side from the first water-blocking nozzle; and the second water-blocking mechanism may include a second water-blocking roll provided at the upstream side from the second water-blocking nozzle.

(15) In the cooling device that cools the hot-rolled steel strip according to (8) or (9), the rapid cooling device may cool only an upper surface of the hot-rolled steel strip.

(16) In the cooling device that cools the hot-rolled steel strip according to (8) or (9), the rapid cooling device may cool an upper surface and a lower surface of the hot-rolled steel strip, and a cooling performance for the upper surface of the hot-rolled steel strip is not less than 0.8 times and not more than 1.2 times of a cooling performance for the lower surface of the hot-rolled steel strip.

Effects of the Invention

According to the present invention, if a temperature variation locally occurs in the steel strip, a portion where the temperature is high rapidly cools down and a portion where the temperature is low slowly cools down, therefore, the temperature deviation in the hot-rolled steel strip becomes uniform. As a result, the uniform cooling of the steel strip can be achieved.

In other words, it is preferable to perform cooling of the steel strip with cooling water having high water amount density such that the temperature of the steel strip target surface decreases from a first temperature of not lower than 600° C. and not higher than 650° C. to a second temperature of not higher than 450° C. In this case, the duration for the transition boiling state cooling can be made shorter than 20% of the duration for which a part of the steel strip passes through a region where the steel strip is cooled with the cooling water in the above-described water amount density (rapid cooling region). Accordingly, the temperature deviation in the hot-rolled steel strip after passing through the rapid cooling region can be made equal to or smaller than the temperature deviation in the hot-rolled steel strip before passing through the rapid cooling region.

EMBODIMENTS OF THE INVENTION

The inventors found that it is advantageous to:

(1) cool the steel strip with cooling water having the water amount density (amount of water per unit area and unit time supplied on the steel strip) of not lower than 4 $m^3/m^2$/min and not higher than 10 $m^3/m^2$/min such that the temperature of the steel strip target surface decreases from a first temperature of not lower than 600° C. and not higher than 650° C. to a second temperature of not higher than 450° C.; and (2) perform the cooling in a condition that at least 80% area of the steel strip target surface is a portion where a plurality of the spray jets of the cooling water directly strike on the steel strip target surface, in the following point.

That is, the duration for the transition boiling state cooling can be made shorter than 20% of the cooling duration in the rapid cooling region, whereby it is possible to decrease the temperature deviation in the steel strip after passing through the rapid cooling region from that before passing through the rapid cooling region.

Hereinafter, an embodiment of the present invention which is derived on the basis of the above finding will be explained with reference to the drawings.

Figure 1:
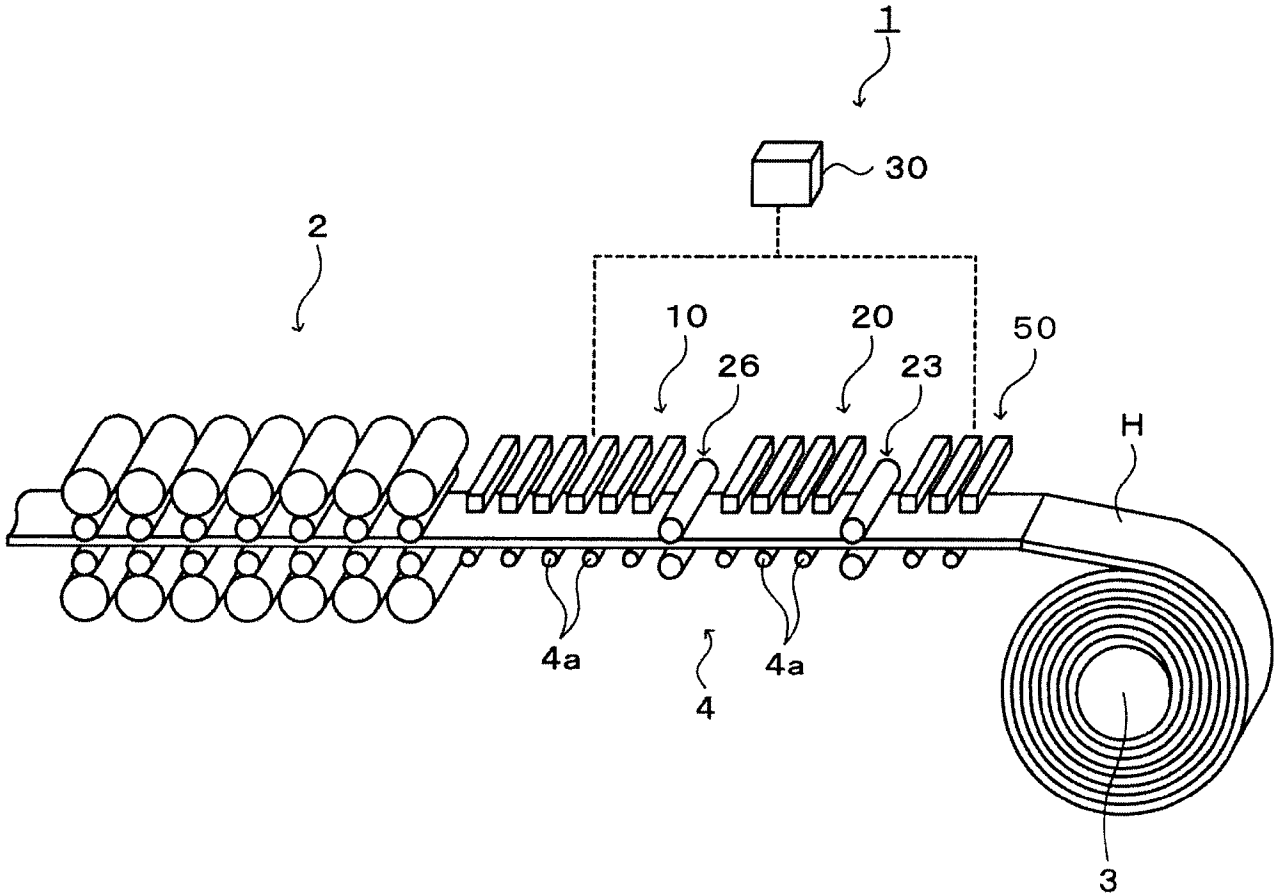
FIG. 1 is a schematic perspective view of a hot-rolling facility including a cooling device according to an embodiment of the present invention.

FIG. 1 shows a schematic view of a configuration after a finishing rolling mill 2 in a hot-rolling facility with a cooling device 1 according to this embodiment. In the hot-rolling facility in this embodiment, a steel strip H is transported at the feeding velocity of approximately 3 to 25 msec, which is a normal operation condition.

As shown in FIG. 1, the hot-rolling facility includes a finishing rolling mill 2 that continuously rolls the steel strip H which is discharged from a heating furnace (not shown) and then rolled by a rough rolling mill (not shown), a cooling device 1 that cools the steel strip H after passing through the finishing rolling to, for example, approximately 350° C., and a coiler 3 that coils the cooled steel strip H. Between the finishing rolling mill 2 and the coiler 3, a run-out table 4 with a table roll 4*a* is provided. Then, the steel strip H which is rolled by the finishing rolling mill 2 is cooled by the cooling device 1 while being transported by the run-out table 4, and then coiled by the coiler 3.

Figure 2:
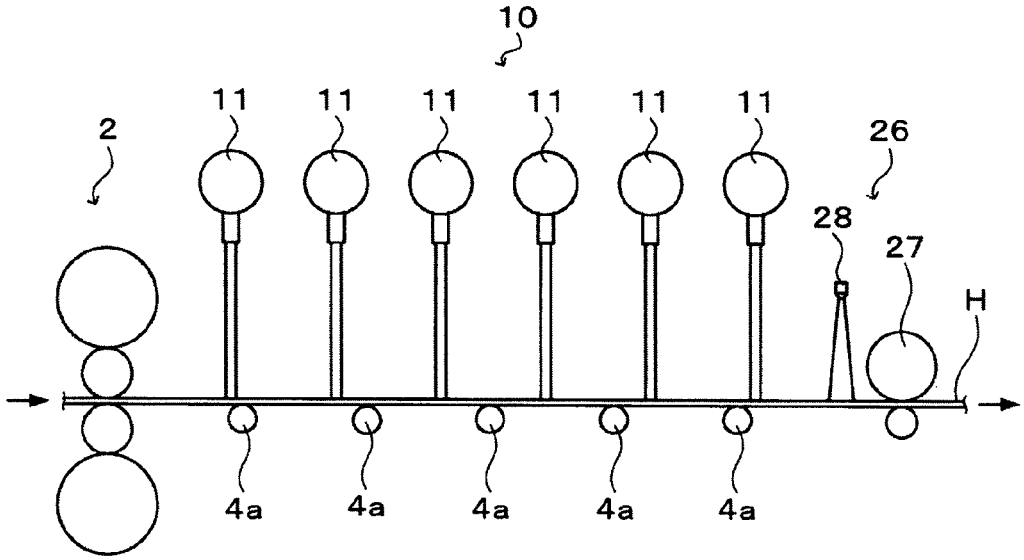
FIG. 2 is a schematic side view of a finishing rolling mill, a cooling device, and an upstream side water-blocking mechanism.

A cooling device 10 that cools the steel strip H immediately after passing through the finishing rolling mill 2 is arranged at the most upstream side in the cooling device 1, that is, at the immediate downstream side from the finishing rolling mill 2. The cooling device 10 has a plurality of laminar nozzles 11 that eject cooling water onto the steel strip H, as illustrated in FIG. 2. The plurality of laminar nozzles 11 are arranged in line with the widthwise direction and the rolling direction of the steel strip H. The water amount density of the cooling water ejected from the laminar nozzles 11 onto the steel strip H may be, for example, 1 $m^3/m^2$/min. Then, the steel strip H, which has passed through the finishing rolling mill 2 and has a steel strip target surface with a temperature of not higher than 840° C. and not lower than 960° C., is cooled such that the temperature reaches a target temperature of not lower than 600° C., with the cooling water ejected from the laminar nozzles 11. The target temperature needs to be higher than the transition boiling start temperature of the cooling water ejected from the laminar nozzle 11, by at least 30° C. For example, if the temperature is higher than the transition boiling start temperature by approximately 10° C., the impact point of the cooling water ejected from the laminar nozzle 11, where the cooling performance is locally high, tends to reach the transition boiling start temperature. Accordingly, it is preferable that the target temperature be higher than the transition boiling start temperature by at least 30° C. Meanwhile, the transition boiling start temperature varies depending on the water amount density, the feeding velocity, the cooling water temperature and the like. Accordingly, the temperature may be suitably adjusted based on the test operation result of the hot-rolling facility. For example, as is known, the transition boiling start temperature increases when the water amount density of the cooling water used in the laminar cooling is high, accordingly, the target temperature needs to be raised. Meanwhile, as the steel strip feeding velocity decreases, the transition boiling start temperature increases. For example, if the feeding velocity is set to be approximately 2 m/sec which is not a normal operation condition, the temperature will become approximately 620° C. On the other hand, as the feeding velocity increases, the transition boiling start temperature decreases, that is, if the feeding velocity is set to be approximately 25 m/sec, the temperature will become approximately 530° C. For example, if the water amount density of the cooling water used in the laminar cooling is lower than 1 $m^3/m^2$/min, the target temperature may be set to be a low temperature, such as 600° C. Meanwhile, the cooling device 10 may perform cooling with air or a mixture of air and water (mist).

Figure 3:
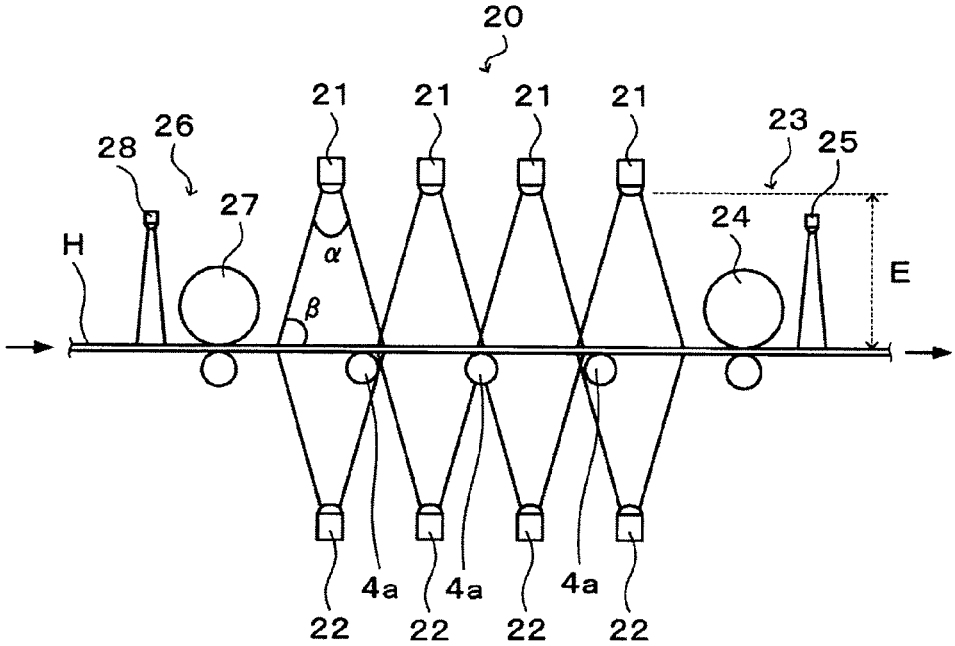
FIG. 3 is a schematic side view of the upstream side water-blocking mechanism, a rapid cooling device, and a downstream side water-blocking mechanism.

A rapid cooling device 20 that cools the steel strip H which has been cooled to the target temperature by the cooling device 10 is provided at the downstream side from the cooling device 10, as illustrated in FIG. 1. The rapid cooling device 20 includes a plurality of spray nozzles 21 at positions facing the steel strip target surface, as illustrated in FIG. 3. Each of the spray nozzles ejects cooling water in the conical manner toward the steel strip target surface. The spray nozzle 21 may be arranged at a position where the height E from the steel strip H (the distance from the steel strip target surface to the lower end of the spray nozzle 21) is not less than 700 mm, for example, 1000 mm. This makes it possible to avoid the conveyed steel strip H from interfering with the spray nozzles 21 or other devices, whereby the damage to the spray nozzles 21 or the steel strip H can be prevented. Meanwhile, if the lower end position of the spray nozzle 21 is set to be approximately 300 mm with a device for holding the steel strip H provided at the upstream side of the facility, it is possible to avoid the steel strip H from interfering with the spray nozzle 21.

Figure 4A:
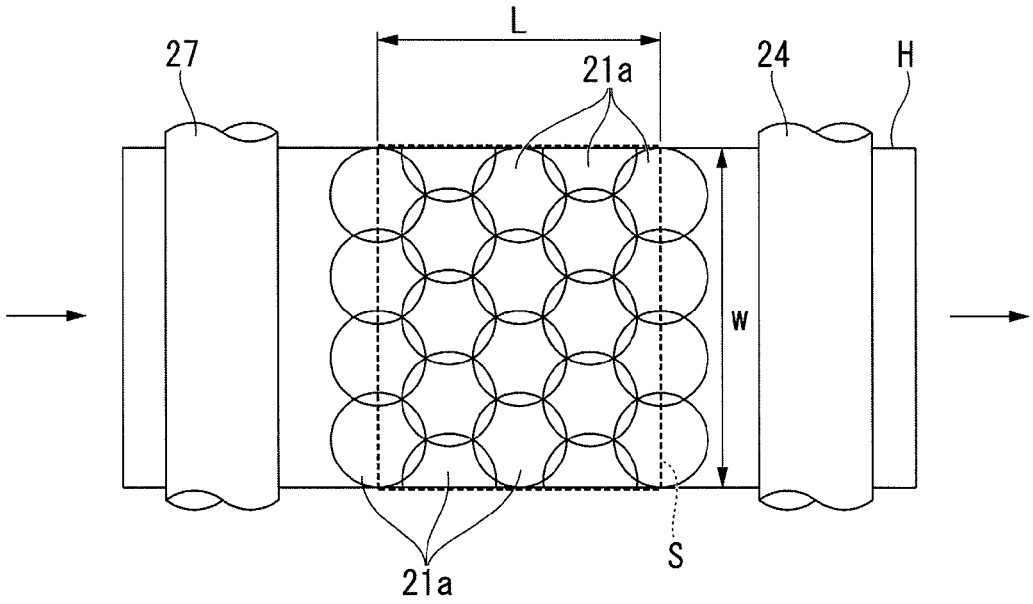
FIG. 4A shows an example in which spray nozzles are arranged such that spray jet impact sections cover at least 80% area of a steel strip target surface.
Figure 4B:
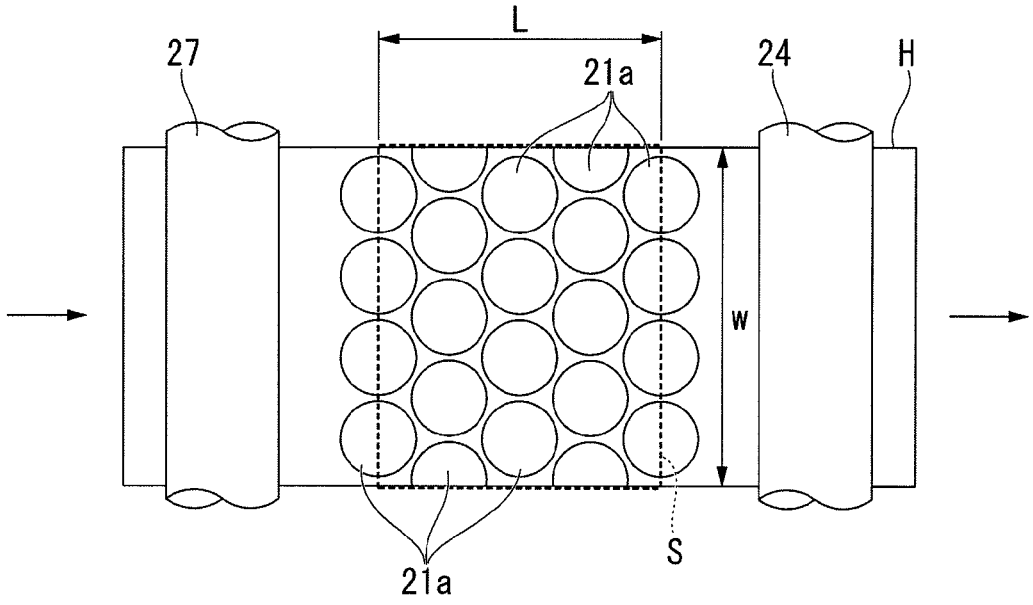
FIG. 4B shows an example in which spray nozzles are arranged such that spray jet impact sections cover approximately 80% area of a steel strip target surface.

As illustrated in FIGS. 4A and 4B, the spray nozzles may be arranged such that spray jet impact sections 21*a* cover at least 80% area of the steel strip target surface. In other words, the spray nozzles 21 eject the cooling water such that the cooling water strikes on at least 80% area of the steel strip target surface in the rapid cooling. In the present invention, the spray jet impact sections 21*a* correspond to a part of the steel strip target surface, on which the cooling water ejected from the spray nozzles 21 directly strikes. In addition, the steel strip target surface corresponds to the area S defined by a product of L and w, where L is the distance from the center of the spray jet impact section 21*a* arranged at the most upstream side to the center of the spray jet impact section 21*a* arranged at the most downstream side, and w is the width of the steel strip H. FIG. 4A illustrates an example in which the spray nozzles 21 are arranged such that the spray jet impact sections 21*a* cover at least 80% area of the steel strip target surface. Further, FIG. 4B illustrates an example in which spray nozzles 21 are arranged such that the spray jet impact sections 21*a* cover approximately 80% area of the steel strip target surface. In the cooling of the steel strip H, the cooling performance is significantly different between a spray jet impact portion and a non spray jet impact portion. Accordingly, if the steel strip includes both of the spray jet impact portion cooled with a high cooling performance and the non spray jet impact portion cooled with a low cooling performance, though the temperature of the steel strip target surface is reduced at the spray jet impact portion, the recovery heat from the inside of the steel strip H caused due to the decrease of the cooling performance at the non spray jet impact portion obstructs the reduction of the temperature of the steel strip target surface. In the film boiling state and the nucleate boiling state in which a relation between the temperature of the steel strip cooling surface and the heat flux is a positive slope, the obstruction does not cause a significant temperature deviation with respect to the decrease of the temperature deviation in the steel strip H. However, in the transition boiling state, due to the obstruction of the temperature reduction of the steel strip cooling surface, the duration for staying the transition boiling state cooling increases, thereby increasing the temperature deviation. Accordingly, by arranging the spray nozzles 21 such that the spray jet impact sections 21*a* cover at least 80% area of the steel strip target surface as illustrated in FIG. 4A, it is possible to make the duration for the transition boiling state cooling to be shorter than 20% of the duration in the rapid cooling region, whereby the increase of the temperature deviation can be avoided. In addition, if the water amount density is sufficiently high, as illustrated in FIG. 4B, the spray nozzles may be arranged such that the spray jet impact sections 21*a* cover approximately 80% area of the steel strip target surface. This makes it possible to cool the steel strip H in a condition such that the duration for the transition boiling state cooling in the rapid cooling region is shorter than 20% of the duration for the cooling in the rapid cooling region. In addition, as to the spray jet impact sections 21*a* of the cooling water ejected from the corresponding spray nozzles 21, it is preferable that the adjacent spray jet impact sections 21*a* of the cooling water ejected from the spray nozzles 21 do not interfere with each other beyond the necessity. Further, though FIG. 4A illustrates a case where all of the nozzles eject the cooling water, all of the nozzles do not need to eject the cooling water if the spray jet impact sections 21*a* cover at least 80% area of the steel strip target surface.

The water amount density of the cooling water ejected onto the steel strip target surface of the upper surface of the steel strip H from the spray nozzles 21 is set to be not lower than 4 $m^3/m^2$/min and not higher than 10 $m^3/m^2$/min. When the water amount density is set to be not lower than 4 $m^3/m^2$/min, it is possible to cool the steel strip H in a condition such that the duration for the transition boiling state cooling is shorter than 20% of the duration for the cooling in the rapid cooling region. Meanwhile, if the water amount density is set to be not lower than 6 $m^3/m^2$/min, more certainly, it is possible to cool the steel strip H in a condition such that the duration for the transition boiling state cooling is shorter than 20% of the duration for the cooling in the rapid cooling region. For example, when the above-mentioned transition boiling start temperature becomes high, it is effective to raise the water amount density. The water amount density of 10 $m^3/m^2$/min is the upper limit of the water amount density in a normal operation condition. In addition, as illustrated in FIG. 3, the spray angle (spreading angle) a of the cooling water is for example not smaller than 3 degrees and not larger than 30 degrees, and the impact angle β of the cooling water spray jet with respect to the steel strip target surface when viewed from the horizontal direction is preferably not smaller than 75 degrees and not larger than 90 degrees. For example, when the cooling water is ejected toward the vertical downward direction in the substantially conical shape with the spray angle $\alpha$ of 30 degrees, the impact angle $\beta$ of the spray jet (spray jet of the center portion) towards the vertical downward direction is 90 degrees, and the impact angle of the spray jet of the circumferential portion is 75 degrees. It is preferable that the impact angle $\beta$ of the cooling water be close to a right angle with respect to the surface of the steel strip H, since the impact pressure can be easily increased, and the uniformity in the ejection range can be improved. In this case, it is possible to improve both of the cooling performance and the uniformity. However, it is difficult to make all of the spray impact angles of the cooling water be a right angle, in terms of the facility layout.

In addition, the impact velocity of the cooling water with respect to the steel strip target surface may be not lower than 20 m/sec. Further, the impact pressure may be not lower than 2 kPa. Upon employing such impact velocity and/or impact pressure, even if the steel strip has an uneven shape such that the residual water tends to stay on the steel strip, it is possible to make the cooling water spray jet directly reach the steel strip target surface. If the cooling water spray jet does not reach the steel strip target surface, the vapor film formed on the steel strip target surface cannot be sufficiently purged, whereby the duration for the transition boiling state cooling will become long. Meanwhile, if the impact velocity is set to be higher than 45 m/sec and the impact pressure is set to be higher than 30 kPa, the effect will saturate. Accordingly, the upper limit of the impact velocity may be 45 m/sec and the upper limit of the impact pressure may be 30 kPa.

As illustrated in FIG. 3, the rapid cooling device 20 may have a plurality of spray nozzles 22 that eject cooling water onto the lower surface of the steel strip H, from under the steel strip H. This makes it possible to rapidly cool the steel strip H and shorten the duration for the transition boiling state cooling. The water amount density, the impact velocity, or the impact pressure of the cooling water ejected onto the lower surface of the steel strip H from the spray nozzles 22 may be controlled to be equivalent to that of the spray nozzle 21. More specifically, the cooling performance of the spray nozzles 22 arranged under the lower surface side of the steel strip H may be controlled so as to be substantially equivalent to the cooling performance of the spray nozzles 21 arranged above the upper surface side of the steel strip H (more specifically, not lower than 0.8 times and not higher than 1.2 times of the cooling performance of the spray nozzles 21 arranged above the upper surface side of the steel strip H), without taking the influence of the cooling water on the steel strip H and the gravity into account. However, upon taking the influence of the cooling water on the steel strip H and the gravity into account, the water amount density, the impact velocity, or the impact pressure of the cooling water ejected onto the lower surface of the steel strip H may be controlled. Then, the steel strip H in which the upper surface temperature is reduced to a target temperature of not lower than 600° C. by the cooling device 10 is cooled with the cooling water ejected from the spray nozzles 21 and 22 of the rapid cooling device 20 such that the rapid cooling region finish temperature of the steel strip reaches the temperature of not higher than 450° C. or 400° C. This rapid cooling region finish temperature may be suitably set based on the mechanical property design of the steel, the thickness of the steel strip H, or the like. In addition, since this rapid cooling region finish temperature varies based on various factors such as the water amount density, the thickness of the steel strip H, and the feeding velocity, this temperature may be suitably adjusted based on the test operation result of the hot rolling facility. Meanwhile, the rapid cooling device 20 may have a configuration in which only spray nozzles 21 are arranged above the upper surface side of the steel strip H. The rapid cooling region start temperature and rapid cooling region finish temperature of the steel strip may be obtained by measuring the steel strip surface with a radiation thermometer. As to the measurement position, the rapid cooling region start temperature can be measured in the vicinity of the upstream side from the spray jet impact section arranged at the most upstream side, and rapid cooling region finish temperature can be measured in the vicinity of the downstream side from the spray jet impact section arranged at the most downstream side.

At the immediate downstream side from the rapid cooling device 20, as illustrated in FIG. 1, a water-blocking mechanism 23 is provided for preventing the cooling water, which is ejected onto the upper surface of the steel strip H by the rapid cooling device 20, from flowing to the downstream side from the rapid cooling device 20. The water-blocking mechanism 23 blocks the cooling water flowing on the upper surface of the steel strip H at the downstream side from the steel strip target surface, that is, at the downstream side from a position where the supply of the cooling water for rapid cooling finishes. The water-blocking mechanism 23 may include water-blocking nozzles 25 that eject blocking water onto the upper surface of the steel strip H. In addition, a water-blocking roll 24 may be provided on the upper surface of the steel strip H, at the upstream side from the water-blocking nozzles 25. In this case, the water-blocking roll 24 can prevent most of the cooling water from flowing to the downstream side, and the water-blocking nozzles 25 further blocking the cooling water, accordingly, the cooling water can be more reliably removed when compared with the case where the water-blocking nozzles 25 are solely used. Further, it is possible to reduce the performance of the water-blocking nozzle 25. In such a manner, the cooling water flowing on the steel strip H is blocked. If the water-blocking is improperly performed, irregular water flow may occur on the steel strip H, thereby causing the temperature variation.

At the immediate upstream side from the rapid cooling device 20 (the downstream side from the cooling device 10), as illustrated in FIG. 1, an upstream side water-blocking mechanism 26 is provided for preventing the cooling water from flowing to the cooling device 10 side. The water-blocking mechanism 26 blocks the cooling water flowing on the upper surface of the steel strip H at the upstream side from the steel strip target surface, that is, at the upstream side from the position where the supply of the cooling water for rapid cooling starts. As illustrated in FIG. 3, the upstream side water-blocking mechanism 26 may include water-blocking nozzles 28, as in the downstream side water-blocking mechanism 23. In addition, a water-blocking roll 27 may be provided at the downstream side from the water-blocking nozzle 28. Then, the cooling water flowing on the upper surface of the steel strip H can be blocked by the upstream side water-blocking mechanism 26. If the water-blocking is improperly performed, irregular water flow may occur on the steel strip H, thereby causing the temperature variation.

Further, as illustrated in FIG. 1, the cooling device 1 may include an additional cooling device 50 at the downstream side from the rapid cooling device 20. This additional cooling device 50 may have a configuration similar to that of the above-described cooling device 10, and may perform not only water cooling, but also air cooling or mist cooling.

In the cooling device 1, as illustrated in FIG. 1, a controlling unit 30 is disposed that controls the temperature of the steel strip H by adjusting the water amount density, the ejecting duration, or the like of the cooling water ejected from nozzles, such as laminar nozzles 11 in the cooling device 10, spray nozzles 21, 22 in the rapid cooling device 20, and laminar nozzles in the additional cooling device 50.

Figure 5:
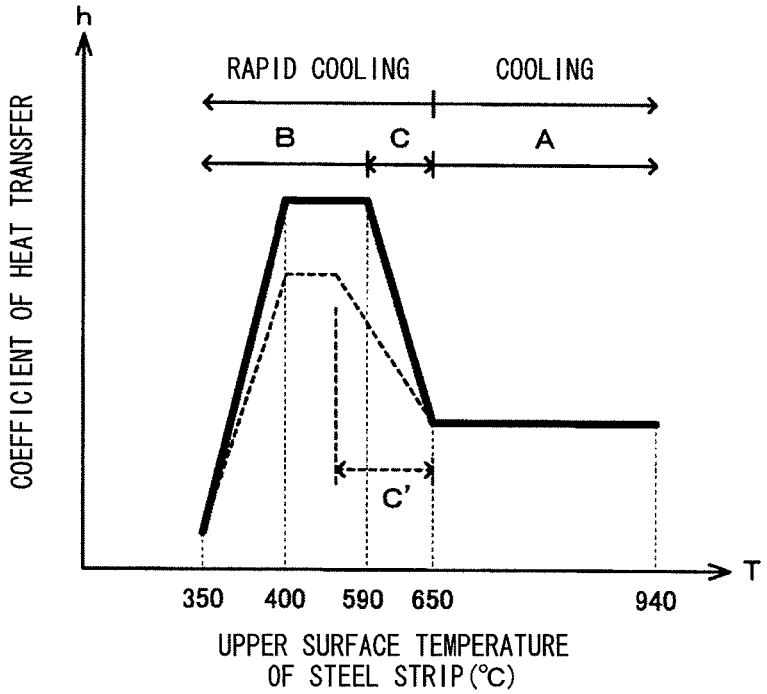
FIG. 5 is a graph showing a relationship between the surface temperature of the steel strip and the coefficient of heat transfer.
Figure 6:
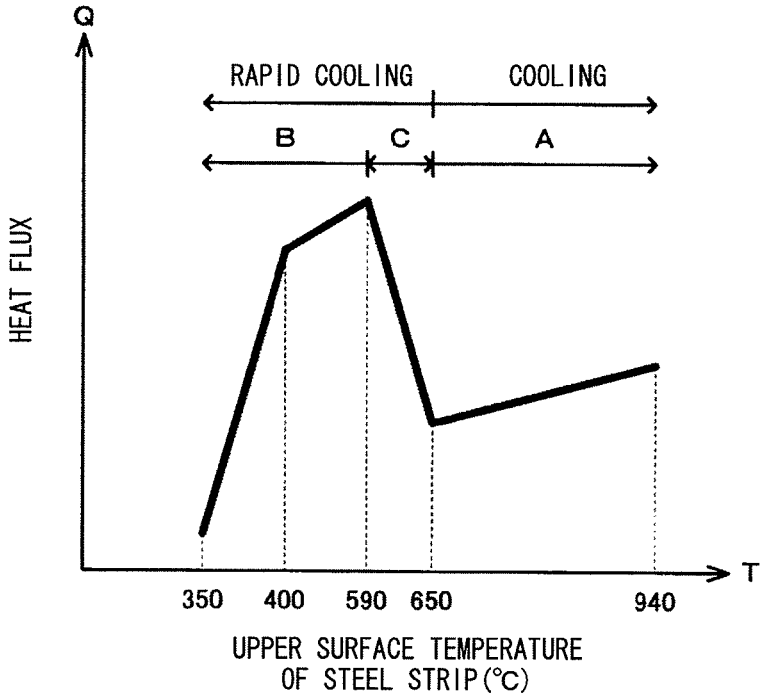
FIG. 6 is a graph showing a relationship between the surface temperature of the steel strip and the heat flux.

Next, a method for cooling the hot-rolled steel strip H according to an embodiment of the present invention will be explained with reference to FIG. 5 and FIG. 6. FIG. 5 is a graph that shows a relationship between the surface temperature T of the steel strip H and the coefficient of heat transfer (cooling performance) h. FIG. 6 is a graph that shows a relationship between the surface temperature T of the steel strip H and the heat flux Q.

The steel strip H which is continuously rolled by a finishing rolling mill 2 and has a surface temperature T of approximately 940° C. is fed to the cooling device 10. In the cooling device 10, the cooling water having the water amount density of approximately 1 $m^3/m^2/min$ which is controlled by the controlling unit 30 is ejected onto the steel strip H. Using the cooling water in this water amount density, the steel strip H can be cooled in the film boiling state A. Note that the cooling device 10 may perform cooling with gas or mixture of gas and water. Then, as illustrated in FIG. 5, the cooling device 10 cools the steel strip H such that the surface temperature T reaches a target temperature of not lower than 600° C. and not higher than 650° C. This target temperature is preferably be higher than the temperature at which the cooling water boiling state converts from the film boiling state to the transition boiling state, when the steel strip H is cooled with the cooling water having the water amount density of not higher than approximately 1 $m^3/m^2/min$. Since the cooling device 10 can cool the steel strip in the film boiling state, it is possible to achieve the uniform cooling of the steel strip. Note that, after a certain period of time has passed from the finishing of the water-cooling, the recovery heat from the inside of the steel strip will proceed. Accordingly, the surface temperature will become substantially equivalent to the inside temperature.

Next, the steel strip H which is cooled such that the surface temperature T is reduced to the target temperature of not lower than 600° C. and not higher than 650° C. is fed to the rapid cooling device 20. In the rapid cooling device 20, the cooling water having the water amount density of not lower than 4 $m^3/m^2/min$ and not higher than 10 $m^3/m^2/min$ is ejected onto the upper surface of the steel strip, and then, as illustrated in FIG. 5, the steel strip is cooled such that the surface temperature T reaches the rapid cooling region finish temperature of not higher than 450° C. Note that the supply amount of the cooling water may be controlled by the controlling unit 30. Hereinbelow is an example where the rapid cooling device 20 cools the upper surface of the steel strip from the rapid cooling region start temperature of 650° C. to the rapid cooling region finish temperature of 350° C.

In the cooling using the rapid cooling device 20, the water amount density of the cooling water ejected onto the steel strip target surface is higher than the water amount density of the cooling water used in the cooling device 10. Accordingly, the range of the transition boiling state C in the steel strip H shifts to the higher temperature side from the range of the transition boiling state C' in the steel strip H in the cooling device 10 (see FIG. 5). In the cooling by means of the rapid cooling device 20, the steel strip H is cooled in the transition boiling state C when the temperature of the target surface decreases to 590° C., and then, in the nucleate boiling state B, the steel strip H is cooled until the temperature T of the steel strip target surface reaches approximately 300° C. In the rapid cooling device 20, the cooling rate of the steel strip surface is high due to the high water amount density. Accordingly, the transition boiling state C is immediately passed through and the cooling duration of the steel strip H in the transition boiling state C becomes shorter than 20% of the duration for cooling the steel strip H in the rapid cooling region. In the transition boiling state C where the heat flux Q increases as the surface temperature T of the steel strip H decreases, the temperature deviation tends to increase. However, as described above, the cooling duration in the transition boiling state C is short, i.e., shorter than 20% of the duration for cooling the steel strip H in the rapid cooling region. As a result, though the surface of the steel strip H is rapidly cooled in the transition boiling state C, the temperature deviation will increase in the vicinity of the surface, and thus, the cooling amount of the steel strip in the transition boiling state is small since the heat conduction from the inside is small.

Then, as illustrated in FIG. 6, the steel strip is cooled in the nucleate boiling state B. In the nucleate boiling state, as in the film boiling state A, the heat flux Q decreases as the surface temperature T of the steel strip H decreases, therefore, with the reduction of the steel strip temperature, the temperature deviation in the steel strip H decreases. In addition, since the heat flux in the cooling is large and the cooling duration is long, the heat conduction from the inside of the steel strip H is large, whereby the steel strip can be rapidly cooled.

As a result, the temperature deviation is suppressed because of the short duration in the transition boiling state.

Figure 7:
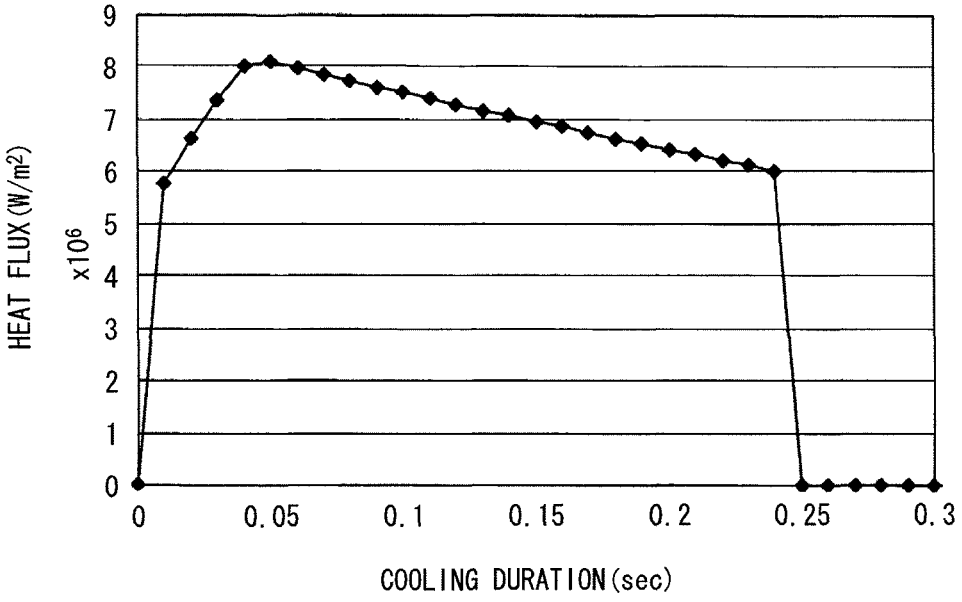
FIG. 7 is a graph showing a relationship between the cooling duration and the heat flux.

FIG. 7 illustrates a relationship between the cooling duration and the heat flux. As illustrated in FIG. 7, a time duration in which the heat flux increases indicates a cooling in the transition boiling state C, and a time duration in which the heat flux decreases indicates a cooling in the nucleate boiling state B. Note that, in the rapid cooling region, the duration for the transition boiling state cooling is shorter than 20% of the cooling duration in the rapid cooling region. Subsequently, a coiler 3 coils the steel strip H which is uniformly cooled to a predetermined temperature.

By ejecting the cooling water having the water amount density of not lower than 4 $m^3/m^2/min$ onto the steel strip target surface using the rapid cooling device 20, the duration for cooling the steel strip H in the transition boiling state C can be suppressed to be shorter than 20% of the cooling duration in the rapid cooling device 20. In this case, according to the findings of the inventors, the temperature deviation in the steel strip H after the cooling by the cooling device 1 can be made smaller than the temperature deviation in the steel strip H before the cooling by the cooling device 1. Therefore, even if a local variance in the temperature is generated in the steel strip H, the temperature distribution in the steel strip H becomes uniform because the high temperature portion rapidly cools down and the lower temperature portion slowly cools down. As a result, the steel strip H can be cooled uniformly. In addition, a cooling device 50 may perform water-cooling after passing through the rapid cooling region. In this case, since the steel strip temperature is decreased to the temperature of not higher than 450° C., the cooling state of the steel strip H is the nucleate boiling state. As explained above, in the nucleate boiling state cooling, the temperature deviation in the steel strip after the cooling device 50 cools the steel strip can be made equal to or smaller than the temperature deviation in the steel strip before the cooling device 50 cools the steel strip.

In addition, in the rapid cooling device 20, the water amount density of the cooling water is large, i.e., not smaller than 4 $m^3/m^2/min$. Therefore, it is possible to shorten the duration for cooling the steel strip H in the nucleate boiling state B. This also makes it possible to reduce the size of the cooling device 1.

Further, the rapid cooling device 20 may eject the cooling water onto at least 80% area of the upper side steel strip target surface with the impact pressure of not lower than 2 kPa. In this case, the distribution or the flow of the cooling water on the steel strip H can be uniformly controlled on the steel strip target surface. In addition, it is possible to purge the vapor film formed on the steel strip target surface by directly striking the cooling water on the steel strip H. Accordingly, the steel strip H can be further uniformly cooled.

Further, the rapid cooling device 20 may eject the cooling water onto at least 80% area of the upper side steel strip target surface with the impact velocity of not lower than 20 msec. In this case, even if the shape of the steel strip H deteriorates, the change of the cooling water impact velocity due to the influence of the shape and the feeding speed is small, thus, the influence of the feeding speed can be suppressed. Accordingly, the steel strip H can be uniformly cooled. Meanwhile, since the presence of a local temperature deviation is a major cause of the shape deterioration, the present invention that reduces the temperature deviation by shortening the cooling duration in the transition boiling state C can also suppress the shape deterioration.

Moreover, the rapid cooling device 20 may eject the cooling water toward the steel strip target surface with the impact angle β of not smaller than 75 degrees and not larger than 90° with respect to the horizontal direction. In this case, each of the cooling water spray jet impact section 21*a* on the steel strip target surface becomes relatively small, and this makes it possible to make uniform the cooling water impact pressure in the spray jet impact section 21*a* and increase the component of the velocity in the vertical direction when the cooling water strikes on the steel strip. Therefore, the impact pressure at the entire steel strip target surface can be uniformly increased, whereby the rapid cooling of the steel strip H can be uniformly achieved.

In addition, spray nozzles 22 which have the same cooling performance equivalent to that of the upper surface side spray nozzles 21 may be arranged at the lower side of the rapid cooling device 20, that is, the spray nozzles 22 which can eject the cooling water in the substantially same conditions, such as the water amount density, the impact velocity, or the impact pressure, as that of the spray nozzles 21, may be arranged at the lower side of the rapid cooling device 20. In this case, it is possible to simultaneously cool the upper surface and the lower surface of the steel strip H. This makes it possible to effectively cool the steel strip H in a short time. In addition, the temperature difference between the upper surface and the lower surface of the steel strip H can be made small, thereby suppressing the deformation of the steel strip H due to the heat stress. When the temperature difference between the upper surface and the lower surface of the steel strip H is large, depending on the steel type, warping may occur due to the heat stress or the like, thereby deteriorating the feedability of the steel strip. However, even in the case of using the steel type in which the warping tends to occur, uniform cooling of the steel strip can be achieved without causing the warping, by setting the cooling performance for cooling the upper surface to be not less than 0.8 times and not more than 1.2 times of the cooling performance for cooling the lower surface. For controlling the cooling performance, the controlling unit 30 can adjust the supply amount of the cooling water. Meanwhile, only the upper surface of the steel strip may be cooled. In this case, it is possible to avoid the scattering of the cooling water from the lower surface due to the blowing up of the cooling water from the lower surface side, therefore, there is an advantage in that a countermeasure for preventing the scattering of the cooling water to the electric systems or the like can be omitted.

Furthermore, the downstream side water-blocking mechanism 23 and the upstream side water-blocking mechanism 26 may be respectively arranged at the downstream side and the upstream side from the rapid cooling device 20. In this case, the cooling water ejected onto the upper surface of the steel strip H by the rapid cooling device 20 can be prevented from flowing to the upstream side and the downstream side from the rapid cooling device 20. This makes it possible to prevent the cooling water from irregularly flowing on the steel strip H, thereby achieving the uniform cooling. In addition, the downstream side water-blocking mechanism 23 and the upstream side water-blocking mechanism 26 may include a water-blocking roll 24 or 27 in addition to the water-blocking nozzles 25, 28. In this case, water-blocking can be more reliably performed.

In the above-explained embodiment, the cooling device 10 includes laminar nozzles 11, but instead of the laminar nozzles, the cooling device 10 may include spray nozzles (not shown). These spray nozzles may be arranged at intervals larger than the intervals of the spray nozzles 21 in the rapid cooling device 20. Further, the water amount density of the cooling water ejected from the spray nozzles in the cooling device 10 may be smaller than the water amount density of the cooling water from the spray nozzles 21 in the rapid cooling device 20.

In the above-explained embodiment, the cooling device 10 ejects the cooling water onto the steel strip H, but instead of or in addition to this configuration, the cooling device 10 may cool the steel strip H by ejecting a gas (air). Further, without using the cooling water, the steel strip H may be cooled by placing it in the air.

Thus far, the preferable embodiment of the present invention has been described in detail with reference to the accompanying drawings, but the present invention is not limited to such examples, and thus any persons with common knowledge in the technical field of the present invention can imagine a variety of modifications within the technical scope of the present invention described in claims, and therefore such modifications are not to be regarded as a departure from the scope of the present invention.

EXAMPLES

Hereinafter, Examples 1 to 7 and Comparative Examples 1 to 3 using a cooling device 1 including a cooling device 10 and a rapid cooling device 20 as illustrated in FIG. 1 will be explained. In Examples 1 to 7 and Comparative Examples 1 to 3, the experiments were carried out by providing a finishing rolling mill 2, a cooling device 1, and a coiler 3 in this order, and then cooling the finish rolled steel strip to the predetermined temperature by the cooling device 1.

Figure 8A:
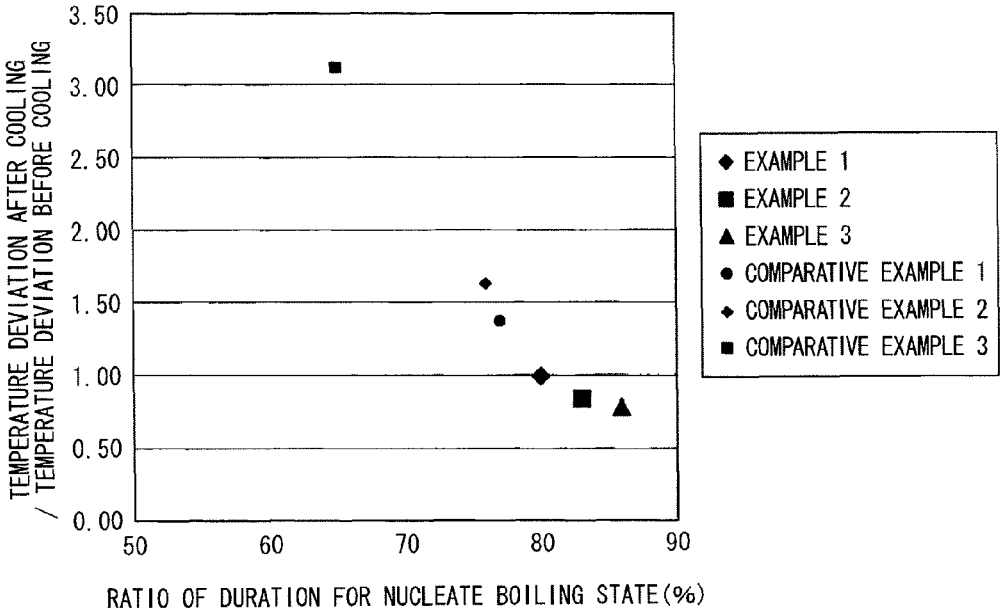
FIG. 8A is a graph showing a relationship between the ratio of a duration for a nucleate boiling state cooling, and the ratio of "the temperature deviation after the cooling/the temperature deviation before the cooling".
Figure 8B:
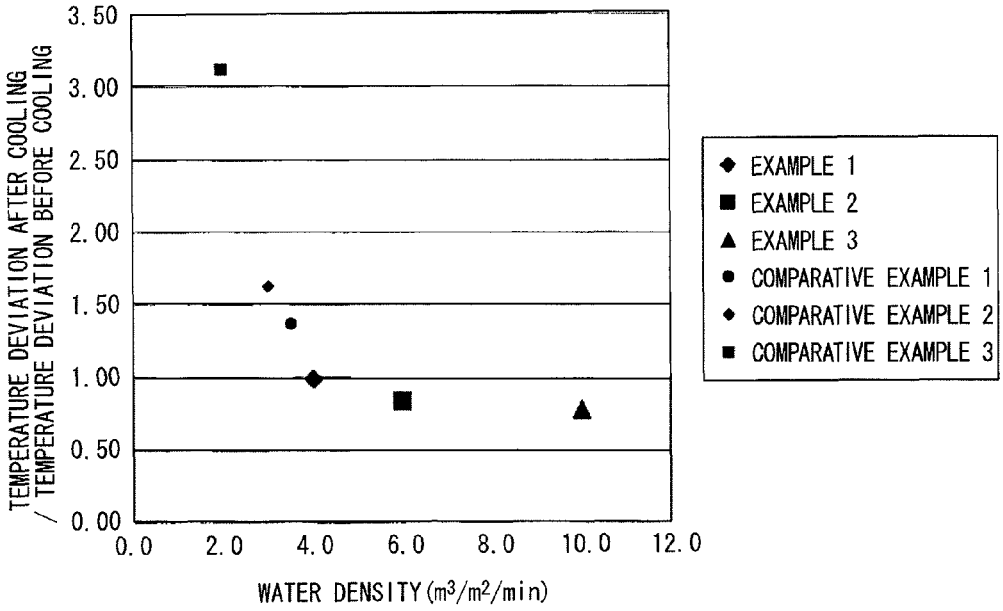
FIG. 8B is a graph showing a relationship between the water amount density of the cooling water and the ratio of "the temperature deviation after the cooling/the temperature deviation before the cooling".
Figure 9:
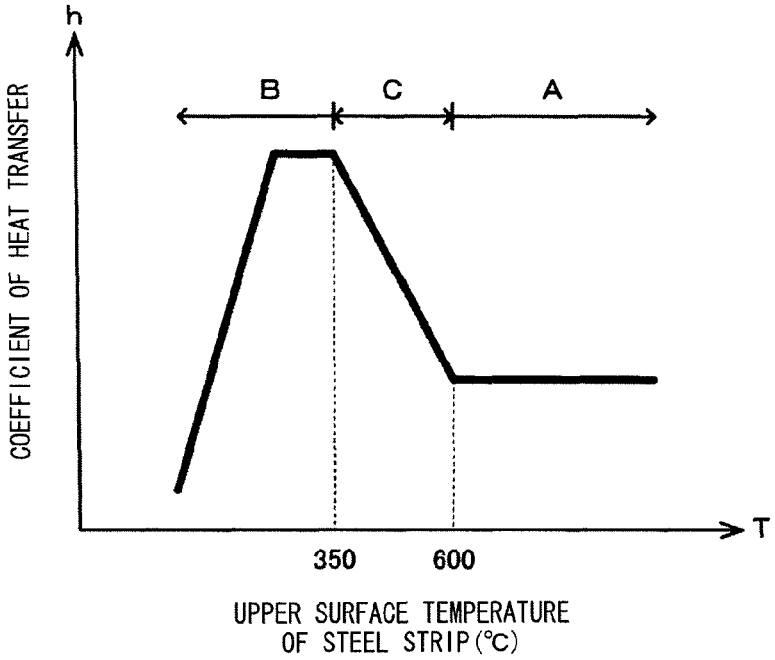
FIG. 9 is a graph showing a relationship between the surface temperature of the steel strip and the coefficient of heat transfer, in a general steel strip cooling method.
Figure 10:
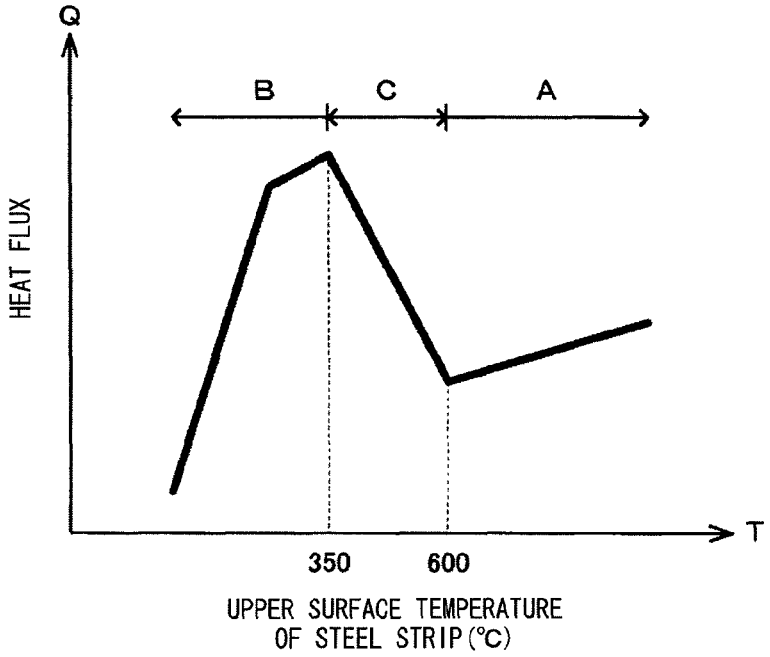
FIG. 10 is a graph showing a relationship between the surface temperature of the steel strip and the heat flux, in a general steel strip cooling method.

Table 1 shows mutual conditions employed in Examples 1 to 7 and Comparative Examples 1 to 3, with respect to the finishing rolling mill 2 and the cooling device 1. Further, in Examples 1 to 7 and Comparative Examples 1 to 3, experiments were carried out by changing the other conditions of the rapid cooling device, as shown in Table 2. The "Ratio of duration for the transition boiling state cooling" in Table 2 indicates the ratio of "the cooling duration in which a part of the steel strip is cooled in the transition boiling state B" to "the cooling duration in which the part of the steel strip is cooled by the rapid cooling device". Then, comparing the temperature deviation before cooling the steel strip by the rapid cooling device and the temperature deviation after cooling the steel strip by the rapid cooling device for evaluating the steel strip cooling effect, the ratios of "Temperature deviation after cooling/temperature deviation before cooling" are obtained as indicated in Table 2. Each of the temperatures of the steel strip before and after the rapid cooling is measured by using a radiation thermometer, as a non-contact type thermometer. The temperature before the rapid cooling was obtained by measuring the temperatures of the steel strip at 5 points along the width direction of the steel strip at the constant intervals, at the upstream side from the spray jet impact section arranged at the most upstream side by 50 cm, and then calculating the average temperature. In addition, the temperature after the rapid cooling was obtained by measuring the temperatures at 5 points of the steel strip along the width direction of the steel strip at the constant intervals, at the downstream side from the spray jet impact section arranged at the most downstream side by 50 cm, as a portion where the recovery temperature becomes constant, and then calculating the average temperature. The evaluation results of Examples 1 to 3 and Comparative Examples 1 to 3 are indicated in a graph in FIGS. 8A and 8B. In FIGS. 8A and 8B, only the data of Examples 1 to 3 which are representative examples of the present invention among Examples 1 to 7 are plotted in the graph.

TABLE 1

| Finish rolling mill | | | | Cooling device | | | | | | | |
|---|---|---|---|---|---|---|---|---|---|---|---|
| | | | | Cooling device | | Rapid cooling device | | | | | |
| Exit temperature ° C. | Temperature deviation in the steel strip ° C. | Thickness of the steel strip mm | Feeding velocity of the steel strip m/sec | Nozzle type — | Cooling medium water dencity $m^3/m^2/min$ | Cooling nozzle — | Nozzle height mm | Water pressure MPa | Cooling finish temperature ° C. | Upstream side draining — | Downstream side draining — |
| 940 | 22 | 3 | 10 | Laminar nozzle | 1.0 | Full corn type | 1000 | 0.6 | 420 | Use | Use |

TABLE 2

| Rapid cooling device | | | | | | | | | | | | |
|---|---|---|---|---|---|---|---|---|---|---|---|---|
| Item Unit | Spreading angle degree | Impact velocity m/sec | Impact pressure kPa | Impact area ratio % | Target surface — | Cooling start temp. ° C. | Temperature deviation in the steel strip before cooling ° C. | Cooling water amount density $m^3/m^2/min$ | Ratio of duration for the transition boiling state cooling — | Temperature deviation in the steel strip after cooling ° C. | Cooling duration sec | Temperature deviation after cooling/temperature deviation before cooling — |
| Example 1 | 15 | 20 | 2 | 80 | Upper and lower surfaces | 620 | 20.0 | 4.0 | 19% | 19.8 | 0.21 | 0.99 |
| Example 2 | 15 | 20 | 3 | 80 | Upper and lower surfaces | 620 | 20.0 | 6.0 | 17% | 16.8 | 0.16 | 0.84 |
| Example 3 | 15 | 20 | 4 | 80 | Upper and lower surfaces | 620 | 20.0 | 10.0 | 14% | 15.5 | 0.13 | 0.78 |
| Example 4 | 15 | 20 | 2 | 90 | Upper and lower surfaces | 620 | 20.0 | 4.0 | 19% | 19.6 | 0.20 | 0.98 |
| Example 5 | 15 | 20 | 2 | 80 | Upper and lower surfaces | 620 | 20.0 | 4.0 | 19% | 19.5 | 0.20 | 0.98 |
| Example 6 | 15 | 25 | 2 | 80 | Upper and lower surfaces | 620 | 20.0 | 4.0 | 19% | 19.7 | 0.21 | 0.99 |
| Example 7 | 15 | 20 | 2 | 80 | Upper and lower surfaces | 620 | 20.0 | 4.0 | 10% | 14.5 | 0.38 | 0.73 |
| Comparative Example 1 | 15 | 20 | 1.7 | 80 | Upper and lower surfaces | 620 | 20.0 | 3.5 | 23% | 27.5 | 0.23 | 1.38 |
| Comparative Example 2 | 15 | 20 | 1.5 | 80 | Upper and lower surfaces | 620 | 20.0 | 3.0 | 24% | 32.7 | 0.25 | 1.64 |
| Comparative Example 3 | 15 | 20 | 1 | 80 | Upper and lower surfaces | 620 | 20.0 | 2.0 | 35% | 62.5 | 0.28 | 3.13 |

With reference to Table 2 and FIGS. 8A and 8B, in each of Comparative Examples 1 to 3, the "Ratio of duration for the transition boiling state cooling" was not less than 20%, and the "temperature deviation after cooling/temperature deviation before cooling" was more than 1. On the other hand, in each of Examples 1 to 7, the "Ratio of duration for the transition boiling state cooling" was less than 20%, and the "temperature deviation after cooling/temperature deviation before cooling" was not more than 1. That is, it was confirmed that if the "Ratio of duration for the transition boiling state cooling" was less than 20%, the temperature deviation in the steel strip before cooling becomes small after the cooling. In addition, the "water amount density" in each of Comparative Examples 1 to 3 was lower than 3.5 $m^3/m^2/min$ and the "temperature deviation after cooling/temperature deviation before cooling" was higher than 1. On the other hand, the "water amount density" in each of Examples 1 to 7 was not lower than 4.0 $m^3/m^2/min$, and the "temperature deviation after cooling/temperature deviation before cooling" was not more than 1. Accordingly, it was confirmed that when the cooling water having the water amount density of not lower than 4.0 $m^3/m^2/min$ as in the present invention, it is possible to make the "Ratio of duration for the transition boiling state cooling" be less than 20%, whereby the temperature deviation in the steel strip before cooling can be lowered after the cooling.

As explained above, according to the cooling method in the present invention, even if the steel strip includes a temperature deviation, the steel strip can be cooled without increasing the temperature deviation. In addition, since the uniform cooling of the steel strip can be achieved, the steel strip which is uniform in terms of the steel material can be also obtained.

Comparing Examples 1 to 3, it was confirmed that when the impact pressure of the cooling water with respect to the steel strip is set large and the water amount density of the cooling water is set large, the temperature deviation in the steel strip before the cooling can be further decreased after the cooling.

Further, comparing Example 1 and Example 4, it was confirmed that when the impact area of the cooling water to the steel strip is set large, the temperature deviation in the steel strip before cooling can be further decreased after the cooling.

Further, comparing Example 1 and Example 5, it was confirmed that when the spreading angle of the cooling water ejected from the cooling nozzle of the rapid cooling device is narrow, the temperature deviation in the steel strip before cooling can be further decreased after the cooling.

Further, with reference to Example 1 and Example 6, it was confirmed that when the impact velocity of the cooling water with respect to the steel strip is raised, the temperature deviation in the steel strip before the cooling can be further decreased after the cooling.

Further, with reference to Example 7, it was confirmed that even when the cooling water is ejected onto only the upper surface of the steel strip in the rapid cooling device, when the "Ratio of duration for the transition boiling state cooling" is less than 20%, the temperature deviation in the steel strip before the cooling can be decreased after the cooling.

The above examples and the embodiments are merely examples of the embodiment for carrying out the present invention, and the technical range of the present invention should not be limited to only these examples. That is, the present invention can be carried out in variety of the embodiment without beyond the technical idea or the main features.

INDUSTRIAL APPLICABILITY

The present invention is useful for a cooling method and cooling device that cool hot-rolled steel strips after hot finishing rolling.

REFERENCE SYMBOL LIST

1: cooling device
2: finishing rolling mill
3: coiler
4: run-out table
4*a*: table roll
10: cooling device
11: laminar nozzle
20: rapid cooling device
21: spray nozzle (upper surface side)
21*a*: spray jet impact section
22: spray nozzle (lower surface side)
23: water-blocking mechanism (downstream side)
24: water-blocking roll (downstream side)
25: water-blocking nozzle (downstream side)
26: water-blocking mechanism (upstream side)
27: water-blocking roll (upstream side)
28: water-blocking nozzle (upstream side)
30: controlling unit
50: additional cooling device
A: film boiling state
B: nucleate boiling state
C: transition boiling state
H: steel strip

The invention claimed is:

1. A cooling device that cools a hot-rolled steel strip which has passed through a finishing rolling, the cooling device comprising:

a rapid cooling device that cools a target surface of the hot-rolled steel strip from a first temperature of not lower than 600° C. and not higher than 650° C. to a second temperature of not higher than 450° C., with cooling water in a water amount density of not lower than 4 $m^3/m^2/min$ and not higher than 10 $m^3/m^2/min$, with respect to an area of the target surface, an area of a portion where a plurality of spray jets of the cooling water directly strike on the target surface is at least 80%.

2. The cooling device that cools the hot-rolled steel strip according to claim 1, wherein the rapid cooling device comprises a plurality of spray nozzles that eject the cooling water, the plurality of the spray nozzles ejecting the cooling water such that the cooling water strikes on the target surface with a velocity of not lower than 20 m/sec.

3. The cooling device that cools the hot-rolled steel strip according to claim 1 or 2, wherein the rapid cooling device comprises a plurality of spray nozzles that eject the cooling water, the plurality of the spray nozzles ejecting the cooling water such that the cooling water strikes on the target surface with a pressure of not lower than 2 kPa.

4. The cooling device that cools the hot-rolled steel strip according to claim 1 or 2, wherein the rapid cooling device comprises a plurality of the spray nozzles eject the cooling water in a conical shape, and an impact angle of the cooling water to the target surface is not smaller than 75 degrees and not larger than 90 degrees when viewed from a steel strip rolling directions.

5. The cooling device that cools the hot-rolled steel strip according to claim 1 or 2, further comprising:

a first water-blocking mechanism that blocks the cooling water which flows on an upper surface of the hot-rolled steel strip at an upstream side from a position where a supply of the cooling water starts; and a second water-blocking mechanism that blocks the cooling water which flows on the upper surface of the hot-rolled steel strip at a downstream side from a position where the supply of the cooling water finishes.

6. The cooling device that cools the hot-rolled steel strip according to claim 5, wherein:

the first water-blocking mechanism comprises a first water-blocking nozzle that ejects blocking water to an upstream side from the target surface; and the second water-blocking mechanism comprises a second water-blocking nozzle that ejects blocking water to a downstream side from the target surface.

7. The cooling device that cools the hot-rolled steel strip according to claim 6, wherein:

the first water-blocking mechanism comprises a first water-blocking roll provided at a downstream side from the first water-blocking nozzle; and the second water-blocking mechanism comprises a second water-blocking roll provided at an upstream side from the second water-blocking nozzle.

8. The cooling device that cools the hot-rolled steel strip according to claim 1 or 2, wherein the rapid cooling device cools only an upper surface of the hot-rolled steel strip.

9. The cooling device that cools the hot-rolled steel strip according to claim 1 or 2, wherein:

the rapid cooling device cools an upper surface and a lower surface of the hot-rolled steel strip; and a cooling performance for the upper surface of the hot-rolled steel strip is not less than 0.8 times and not more than 1.2 times of a cooling performance for the lower surface of the hot-rolled steel strip.

* * * * *